US005184816A

United States Patent [19]

Lunsford

[11] Patent Number: 5,184,816

[45] Date of Patent: Feb. 9, 1993

[54] HITTING PRACTICE DEVICE

[76] Inventor: T. J. Lunsford, 1215 Pioneer Way, El Cajon, Calif. 92020

[21] Appl. No.: 837,164

[22] Filed: Feb. 18, 1992

[51] Int. Cl.[5] ..... A63B 69/40

[52] U.S. Cl. ..... 273/26 E

[58] Field of Search ..... 273/26 E, 29 A, 26 R

[56] References Cited

U.S. PATENT DOCUMENTS

| | | | |
|---|---|---|---|
| 3,333,847 | 8/1967 | Pennington | 273/26 E |
| 3,547,437 | 12/1970 | Anderson | 273/26 E |
| 3,588,104 | 6/1971 | Griffin | 273/26 E |
| 3,626,502 | 12/1971 | Well | 273/26 E |
| 3,762,705 | 10/1973 | Gonzalez | 273/26 R |
| 3,885,790 | 5/1975 | Parr | 273/26 E |
| 4,664,375 | 5/1987 | Tetrault | 273/26 R |
| 4,709,924 | 12/1987 | Wilson et al. | 273/26 R |
| 4,872,675 | 10/1989 | Crowden | 273/26 E |
| 5,018,729 | 5/1991 | Wilkerson | 273/26 E |
| 5,076,581 | 12/1991 | Lang | 273/26 R |
| 5,083,775 | 1/1992 | Heard | 273/26 E |

*Primary Examiner*—Theatrice Brown
*Attorney, Agent, or Firm*—David J. Harshman

[57] ABSTRACT

A hitting practice device comprises a frame on which is mounted a rotatable arm. The arm is attached to a shaft which is driven by a motor also disposed in the frame. Attached to one end of the arm is a tethered ball such as a baseball or a tennis ball. The motor is drivingly connected to the shaft to rotate the arm about the frame and propel the ball repeatedly past a hitter to allow hitting practice.

5 Claims, 1 Drawing Sheet

HITTING PRACTICE DEVICE

FIELD OF THE INVENTION

This invention relates generally to apparatus used for training and practicing hitting in various sports. More specifically, the invention relates to a hitting practice machine which propels a ball past the user in a manner to allow the user to practice attempting to hit the moving ball with an object, such as a bat or tennis racquet. The present invention is particularly, though not exclusively, useful for teaching a prospective baseball player to improve eye-hand coordination through repetitive simulated pitches of a ball past the hitter to allow repeated practice swings to hit the ball.

BACKGROUND OF THE INVENTION

In various sports, such as baseball or tennis, there have machines in the past used to propel balls past the player to allow the player practice hitting the ball, e.g., with a bat or racquet, respectively. In a sport such as baseball, softball, or any sport requiring a ball to be hit by an object such as a bat, racquet, or other object, the key is that the user should make solid contact with the ball. This typically involves good eye-hand coordination, in which the hitter watches the ball as it approaches the hitter until the ball hits the object (e.g., bat) which is swung by the batter. For some people, this comes naturally, but for many, this skill can best be developed through practice. By increasing the number of practice swings at a moving ball, the individual can thereby improve his or her game.

In the past, in baseball, for example, such practice could be accomplished by having an individual throw a ball to the batter. Unfortunately, this requires at least two individuals, one to throw and one to hit. Therefore, there have been machines and devices utilized in the past which automatically throw a ball through a strike zone over a home plate past the batter. Such pitching machines have been in use for many, many years.

One disadvantage of such devices, however, is that such machines require a large area, since typically the pitching machine device throws the ball some distance to the batter. Therefore, the machine needs to be positioned at some distance away from the batter. Also, such machines require a large number of balls. Moreover, the batter typically needs to be enclosed in some kind of cage, so the balls can be easily retrieved once hit. Another disadvantage, is that the large number of balls must be continually somehow retrieved and reloaded into the pitching machine. Therefore, such pitching machine installations tend to be expensive, because they require a large area and costs of construction of the cage due to the high costs of real estate and maintenance. Thus, such prior art devices are typically prohibitively expensive for most consumers to have at their own home.

With respect to baseball in particular, prior art machines also have a further, disadvantage in that they typically are not able to throw various types of pitches such as may be thrown by a human pitcher to a batter in a game, such as sliders, curve balls, sinkers, and the like. Such pitches are thrown by a pitcher in a real baseball game to make the ball move in an unpredictable manner to cause the batter to miss the pitches. Typically, conventional pitching machines cannot throw such pitches, and therefore the batter does not get the benefit of the practice of attempting to hit balls which are moving unpredictably at the batter.

Accordingly, it is an object of the present invention to provide a hitting practice device which is portable, compact and takes up a relatively small area compared to conventional hitting machines.

It is yet another object of the present invention to provide a hitting practice machine which propels a ball past a hitter to allow the hitter to take practice swings hitting the ball.

It is yet another object of the present invention to provide a practice device which propels the ball past the hitter in a manner which allows the hitter to practice hitting various types of pitches in which the ball may move about with some unpredictability.

It is yet another object of the present invention to provide a hitting practice device in which the speed of the "pitches" of the ball past the batter can be varied.

Another object of the present invention is to provide a hitting practice device which is simple and convenient to use.

Still another object of the present invention is to provide a hitting practice device which is economical in construction and reliable in use.

SUMMARY OF THE INVENTION

The preferred embodiment of the novel hitting practice device includes a frame which has a moveable arm rotatably mounted on the frame. At a free end of the arm, a tethered ball is attached. The other end of the arm is attached to a drive shaft. The drive shaft is coupled to and driven by an electric motor mounted in the frame. The shaft is driven by a belt, with pulleys attached to the drive shaft and motor. Upon actuation of the motor, the arm is rotated at a desired angular velocity, such as fifty revolutions per minute, to propel the ball in a circle about the frame at a height comfortable for a hitter to hit the ball. Attached to the bottom of a frame is a lateral guide which lies on the ground upon which a moveable, adjustable home plate may be attached. This assures that the hitter is properly lined up with the device when it is in use. Upon actuation, the tethered ball is continuously propelled about the frame, past the hitter, to simulate a baseball pitch or a tennis shot.

The novel features of this invention, as well as the invention itself, both as to its structure and its operation, will be best understood from the accompanying drawings taken in conjunction with the accompanying description in which similar reference characters refer to similar parts.

DESCRIPTION OF THE PREFERRED EMBODIMENT

Figure 1:
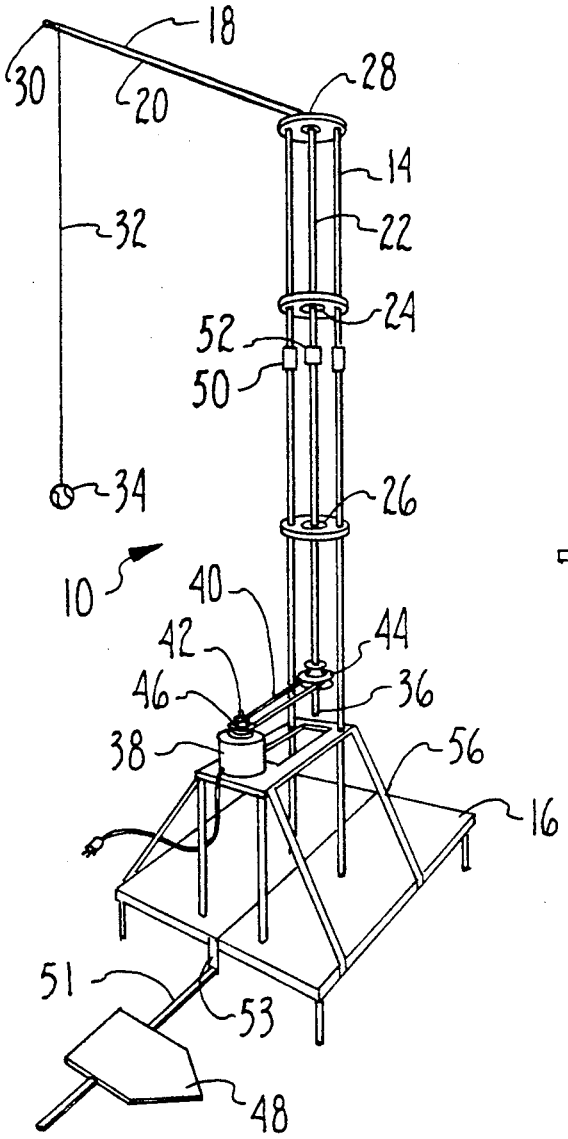
FIG. 1 is a perspective front view of the present invention.

Referring now to FIG. 1 there is shown a hitting practice device generally designated as 10. Hitting practice device 10 comprises a frame 12, which includes an upright frame portion 14 and a base portion 16. Rotatably mounted in frame 12 is arm member 18. In the embodiment shown, arm member 18 comprises a lateral arm 20 which is connected to rotatable shaft 22. In the embodiment shown, shaft 22 is held in vertical position, in rotatable fashion, by bearing support members 24 and 26. Arm member 18 is thus mounted in frame 12 so that arm 20 can rotate in a circular motion about frame 12. Arm 20 is connected to shaft 22 at fixed end 28. At free end 30 of arm 20 there is attached a flexible line or tether 32, such as nylon rope or the like. Attached to the end of tether 32 is a ball 34. Ball 34 can be any type of ball which is desired for hitting practice purposes. In the preferred embodiment, there is shown a baseball or softball which is used for batting practice. Alternatively, a tennis ball or similar type ball can be used which is softer than a baseball for batting purposes. Moreover, a tennis ball can be used to practice one's tennis swing as well.

Shaft 22 of arm member 18 has one end 36 drivingly connected to a motor 38 which is mounted on frame 12. A belt 40 is wrapped around end 36 and motor drive shaft 42. Motor 38 can be any type of motor such as an electric motor or a gasoline motor. Gears and pulleys may be used to adjust the speed of the shaft 22 to the desired revolutions per minute. In the embodiment shown, there is included at shaft end 36 a pulley, and on motor drive shaft 42 there is a drive pulley 46, around which belt 40 is driven by motor 38. By adjusting the sizes of the pulleys, the rotation of shaft 22, and thus arm 20 can be adjusted to the desired revolutions per minute of ball 34 about frame 12.

In addition, it has been found that using belts of varying density and elasticity has an effect on the speed of the rotation of arm 20. The elasticity of various belts can be used to not only adjust the speed of arm 20, but to control the amount of slippage when in the opposite direction when the ball is hit. Some slippage may be desired when hitter 48 hits ball 34, which tends to force arm 20 in a direction opposite to normal direction 58 upon rotation of the arm 20. By allowing some opposite motion of arm 20 when it is pulled by tethered ball 34 because of being hit by hitter 48, it allows some of the forces to be absorbed into the slippage and friction of belt 40 on pulleys 44 and 46.

In a preferred embodiment of the present invention, arm 20 is preferably 3½ feet long, and tether 32 is approximately 3 feet long. In this manner when motor 38 is operated at an angular velocity of 50 r.p.m. the speed of ball 34 can be adjusted by varying the pulley and belt elasticity to speeds of between 30 to 100 miles per hour past hitter 48.

Further with respect to hitting practice device 10, there is shown a home plate 48 which is slidably connected to guide 51, which is connected at mid point 53 on base portion 16 of frame 12. Guide 51 lies on the ground and extends from base portion 16, so that arm 20 is in alignment at one point during its rotation over guide 51 to maintain home plate in a proper radial position for positioning the hitter 48. In addition, home plate 48 can slide laterally along guide 51 toward and away from base portion 16. This is to adjust how close hitter 48 wishes to stand to frame 12 depending upon the speed of motor 38 and thus the circuferential distance of ball 34 in its travel about frame 12.

A further feature of the present invention is that upright portion 14 and shaft 22 have adjustable lengths, as does arm 20, to adjust the height of the flight of the ball 34, and the distance of the ball 34 from frame 12 to accommodate various sized hitters. There are adjusting screws 50, 52 and 54 respectively to make such adjustments. Moreover, there are adjusting screws 56 on base portion 16 so that base 16 can be disassembled. Thus, the device 10 can be disassembled so that it may easily fit, for example, in the trunk of an automobile.

Figure 2:
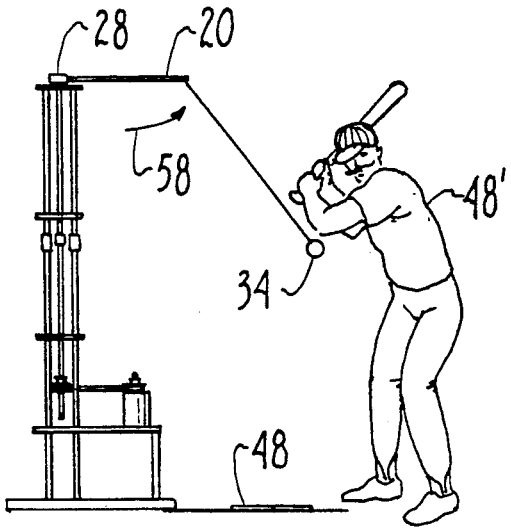
FIG. 2 is a perspective front view of the present invention showing a ball being propelled toward a hitter using the device.
Figure 3:
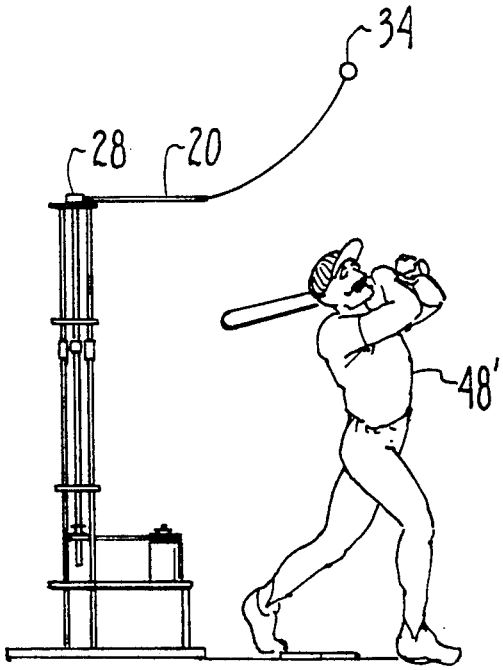
FIG. 3 is a perspective front view of the present invention showing the device in operation after the hitter has hit the ball.

In operation, it has been found that the hitting practice device 10 is very useful in that it can simulate many different types of pitches in which the ball may curve, sink, rise, and the like, to challenge the hitter's skills to greatly improve the hitter's hand-eye coordination. This is unlike conventional batting machines, and tennis pitching machines, which very typically are incapable of throwing the various kind of pitches or balls which may be coming toward a hitter in various sports such as baseball or tennis. Referring now to FIGS. 2 and 3, showing the device 10 in operation, as the arm swings around generally in the direction 58, the tethered ball 34 is propelled and a certain velocity toward hitter 48. When the ball 34 gets to the hitter 48 and is essentially over home plate 48, hitter 48 may swing and hit ball 34. This sends ball 34 in a direction of travel opposite that of direction 58. Tether 32 can accommodate the various directions of the ball 34 once hit since it is a flexible line. At some point, the ball 34 which has been hit by hitter 48 pulls line 32 taught, and tends to pull end 30 of arm 20 in a direction opposite to direction 58, depending on the amount of slippage permitted by belt 40. If a large amount of slippage is permitted, the arm 20 may stop rotating momentarily or even slightly travel in the reverse direction, until belt 40 engages so that it is driven by motor 38. This causes arm 20 to then continue rotating generally in direction 58. On the other hand, if belt 40 is tight, there will be little or no slippage, and arm 20 never stops rotating when ball 34 is hit. Also, when the ball is hit, it jumps and hops around, since the flexible tether allows the ball 34 to move around while arm 20 continues rotating. This simulates various types of pitches as mentioned earlier, and by adjusting the speed, the device 10 can be made to do various things as desired depending on the practice skills needed by hitter 48. When used for improving one's tennis game, two machines can be placed side by side simultaneously to provide both forehand and backhand practice. This is very challenging and entertaining and has been found to be quite effective in improving hitting skills.

While the particular device herein shown and described in detail is fully capable of obtaining the objects and providing the advantages hereinbefore stated, it is to be understood that it is merely illustrative of the presently preferred embodiment of the invention and that no limitations are intended to the details or the construction or design herein shown other than as defined in the appended claims.

I claim:

1. An adjustable hitting practice device for use by a hitter, comprising:

a frame member having means for adjusting the length of said frame member;

a base member removably connected to said frame member for supporting said frame member in a vertical position;

a vertically extending, adjustable length shaft rotatably attached to said frame member;

an adjustable length, laterally extending arm member having one of its ends attached to the upper end of said shaft and a tethered ball attached to its other end;

means to permit adjustment of the length of said shaft and arm member;

driving means connected to and for rotating said shaft and for rotating said lateral arm about said frame member at an angular velocity to repeatedly propel said tethered ball past a hitter, said driving means including a pulley attached to said shaft and a motor, a removable elastic belt connecting said motor and said pulley; and the length of said shaft and said frame member being adjustable to vary the height of said frame member and lateral arm.

2. The device of claim 1, further comprising a home plate and adjustable guide means connecting said home plate and said base member for variably positioning said home plate at desired distances from said base member.

3. The device of claim 2, wherein said ball is a baseball.

4. The device of claim 2, wherein said ball is a softball.

5. The device of claim 2, wherein said ball is a tennis ball.

* * * * *